United States Patent [19]

Russell

[11] 4,139,827

[45] Feb. 13, 1979

[54] HIGH DIRECTIVITY TEM MODE STRIP LINE COUPLER AND METHOD OF MAKING SAME

[75] Inventor: Thomas J. Russell, Sunnyvale, Calif.

[73] Assignee: Krytar, Sunnyvale, Calif.

[21] Appl. No.: 769,035

[22] Filed: Feb. 16, 1977

[51] Int. Cl.[2] ..... H01P 5/18

[52] U.S. Cl. ..... 333/10; 333/84 M

[58] Field of Search ..... 333/10

[56] References Cited

U.S. PATENT DOCUMENTS

| | | | |
|---|---|---|---|
| 3,204,206 | 8/1965 | Harmon | 333/10 |
| 3,315,182 | 4/1967 | Woolley, Jr. | 333/10 |

FOREIGN PATENT DOCUMENTS

| | | | |
|---|---|---|---|
| 2335778 | 2/1975 | Fed. Rep. of Germany | 333/10 |

*Primary Examiner*—Paul L. Gensler

*Attorney, Agent, or Firm*—Lowhurst & Aine

[57] ABSTRACT

A TEM mode strip line directional coupler utilizing an outer conductor having a dielectric slab filled cross section with photo-etched center conductors. The center conductors are arranged to form a coupling portion whose opposite ends define diverging conductors. At least one conductive element, photo-etched simultaneously with the center conductors, of generally arrow-shaped configuration having its end portion immediately adjacent and in between the diverging conductors facing the coupling portion to increase the directivity of the coupler.

14 Claims, 8 Drawing Figures

HIGH DIRECTIVITY TEM MODE STRIP LINE COUPLER AND METHOD OF MAKING SAME

BACKGROUND OF THE INVENTION

This invention relates to TEM mode strip line directional couplers for coupling energy over a broad frequency range from a primary transmission line to a secondary transmission line with high directivity and a method for making them.

In a TEM mode directional coupler, power is coupled from a primary transmission line to a secondary transmission line by bringing the center conductors of these two lines sufficiently close together for a distance of at least one-quarter of a wavelength of the center frequency to cause interaction of the electric and magnetic fields. The end of the secondary transmission line adjacent to the primary transmission line input is connected to an output designated here as the coupled output. The opposite end of the secondary line is terminated in a matched load. In operation, a known fraction of the energy flowing in the forward direction of the primary transmission line will appear at the coupled output. However, almost no energy flowing in the reverse direction in the primary transmission line will appear at the coupled output. Directivity of the coupler is the ratio in dB of the power at the coupled output, when power is transmitted in the primary transmission line forward direction, to the power at the coupled output, when the same amount of power is transmitted in the primary transmission line reverse direction.

The directional property of a TEM mode coupler results from the fact than TEM mode coupling between parallel transmission lines is contra-directional, i.e., the wave induced in one line travels in the opposite direction from the inducing wave in the other line. Any non-TEM mode coupling will degrade directivity.

For most applications, it is desirable to have high directivity so that the signal at the coupled output will be an accurate indication of only the power traveling in the forward direction in the primary transmission line.

While it has been possible in the past to construct TEM mode strip line couplers with high directivity at one particular frequency, it has been most difficult to do so over a broad range of frequencies. In the past, many attempts have been made to increase the directivity over a broad range. One of the solutions proposed is disclosed in U.S. Pat. No. 3,204,206 which issued to Harmon on Aug. 21, 1965.

As described in that patent, conductive elements in the form of posts or shims are positioned in close proximity to the ends of the coupled portion of the transmission lines where the center conductors diverge. The posts have their center lines disposed perpendicular to the plane of the center conductors and the shims are disposed so that the normal to the shim is parallel to the plane of the center conductor. One of the disadvantages of that arrangement is that very careful and critical adjustment of the elements became necessary to maximize directivity and such adjustment has to be carried out on the bench for each coupler. Further, these conductive elements required complex modification of the dielectric slabs, after the photo-edge process, which increased the expense of the coupler.

SUMMARY OF THE INVENTION

The present invention comprises a means and a method for increasing the directivity of TEM mode strip line directional couplers which decreases cost, increases simplicity, and is accurately repeatable. In accordance with the present invention a conductive element is etched from the copper-clad dielectric slab which is placed in the cross section of the outer conductor at the same time as the center conductor of the transmission lines are etched from the slab so that no additional effort or expense is necessary for providing and for accurately locating the conductive element which increases the directivity. The photo-etch process so accurately locates and dimensions the conductive element with respect to the coupled portion of the center conductors that the directivity of all couplers constructed in accordance with the present invention are the same and require no further adjustment. Further, sizing and locating of the conductive elements can be optimized through trial and error and after optimizing is then repeatable, just as the photo-etch process itself.

DETAILED DESCRIPTION OF THE INVENTION

Figure 1:
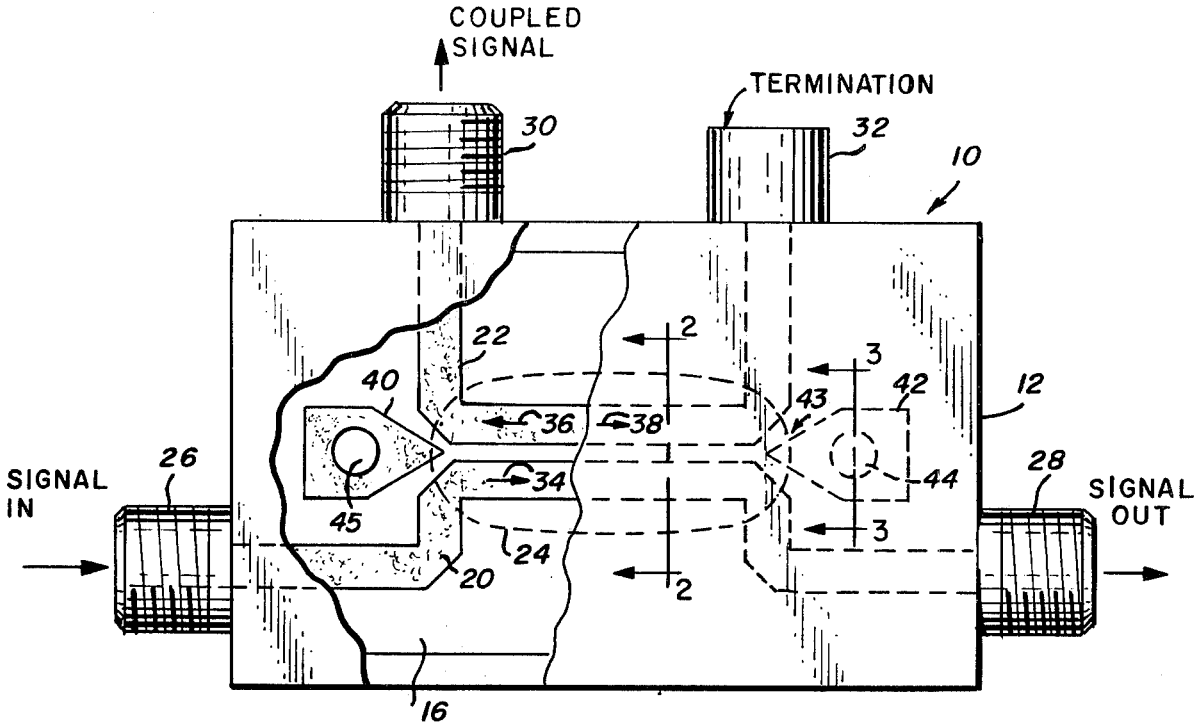
FIG. 1 is a partially cut away top view of a TEM mode strip line coupler in accordance with the present invention showing the position of the conductive elements with respect to the coupled portion.
Figure 2:
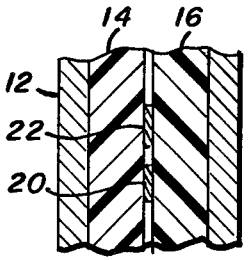
FIG. 2 is a cross-sectional view taken along lines 2—2 of FIG. 1.
Figure 3:
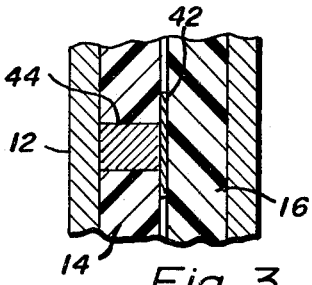
FIG. 3 is a cross-sectional view taken along lines 3—3 of FIG. 1.

Referring now to FIGS. 1, 2 and 3, there is shown a TEM mode strip line coupler 10 constructed in accordance with this invention. Coupler 10 comprises an outer conductor 12 which has a generally rectangular cross section which is filled with two sheets of dielectric 14 and 16. Sheet 16 has laminated to its surface a primary transmission line center conductor 20 and a secondary transmission line center conductor 22 which have an adjacent portion, also referred to as a coupling portion, generally indicated by reference character 24. The ends of coupling portion 24 are defined by the conductors diverging into opposite directions, and the length of portion 24 is generally equal to one-quarter wavelength at the center of the band of frequencies.

The input signal is applied to input terminal 26 of the primary transmission line and leaves the coupler from primary output terminal 28. The signal coupled from line 20 to line 22 by coupling section 24 leaves the coupler from the auxiliary output terminal 30. A termination 32 is provided at the other end of the auxiliary transmission line.

The energy applied to the primary transmission line flows in the direction indicated by arrow 34 and the energy coupled to the auxiliary transmission line flows therein in the direction indicated by arrow 36. Because of the imperfect directivity of the coupler, a small amount of energy coupled into the auxiliary line flows in the direction indicated by small arrow 38 and that energy is absorbed by termination 32.

The structure described so far comprises a typical TEM mode strip line coupler. At the ends of the coupling section 24, formed by the diverging center conductor lines 20 and 22, non-TEM mode coupling exists which degrades directivity. In general this degradation becomes worse with increasing frequency.

There are also provided, on each side of coupling section 24, arrow-like conductive elements indicated by reference characters 40 and 42 which lie in the plane of the center conductors and which have the effect of decreasing the non-TEM mode coupling to thereby improve the coupler directivity. Elements 40 and 42 are substantially alike and are connected, through conductors 44 and 45, respectively to outer conductor 12. Conductive element 42 is generally of elongated configuration, referred to herein as being of arrow shape, having a pointed end 43, not necessarily sharp, pointing at the end of the coupling section where the two lines diverge and where it is desired to decrease non-TEM mode coupling. Optimum location of conductive elements 40 and 42 is determined experimentally. As a practical matter, pointed end 43 is usually positioned quite close to the coupling section end formed by diverging transmission lines 20 and 22, and the conductive connection made to the outer conductor should preferably be not less than approximately one-eighth of the shortest operating wavelength over which the coupler is to operate from that end. It is to be understood that element 42 may also be of a shape which simulates a bullet or perhaps a triangle, each of these being generally pointed.

One of the great advantages of the configuration of conductive element 42 is that it can be accurately located and can be manufactured substantially without any additional cost. Directional couplers like the ones illustrated in FIG. 1, are usually constructed by utilizing a dielectric sheet 16 that is copper-clad and a similar dielectric sheet 14 without any copper thereon. Copper-clad dielectric sheet 16 is subjected to the conventional photo-etched process used extensively in the construction and manufacture of strip lines on solid dielectrics. Elements 40 and 42 are photo-etched at the same time as lines 20 and 22 using the same photo mask. Another possible way of manufacturing would be to selectively deposit the transmission lines and conductive elements. This invention would apply equally well for this manufacturing method, since the conductive elements could be deposited at the same time as the transmission line conductors.

FIGS. 1–3 illustrate a directional coupler in which the primary and the auxiliary transmission lines lie in the same plane and are deposited on the same dielectric sheet. Such couplers are generally employed where only fairly loose coupling is required. In case tight coupling is desired, the primary and the auxiliary transmission lines are usually placed in different planes as illustrated in FIGS. 4–6 in which the same reference characters are used to designate like parts.

Figure 4:
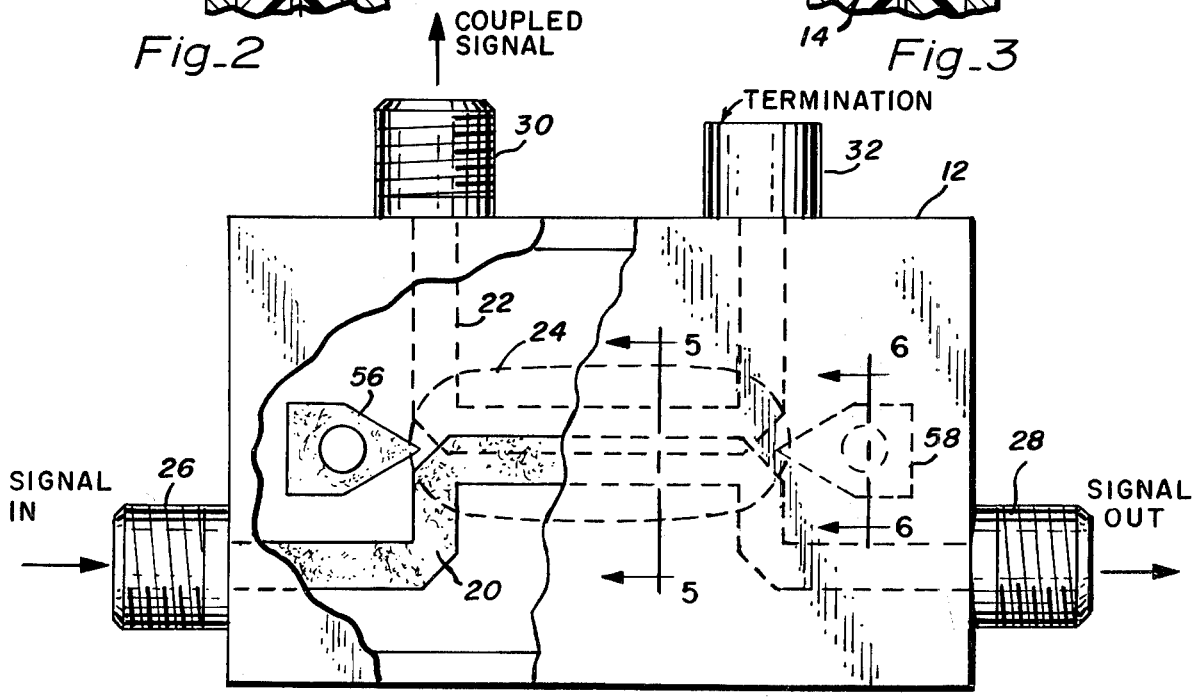
FIG. 4 is a partially cut away view of another embodiment of the TEM mode strip line coupler in accordance with this invention.
Figure 5:
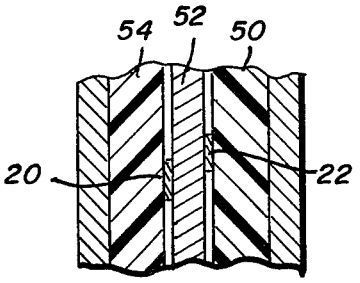
FIG. 5 is a cross-sectional view taken along lines 5—5 of FIG. 4.
Figure 6:
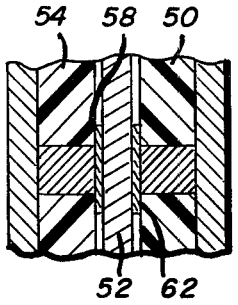
FIG. 6 is a cross-sectional view taken along lines 6—6 of FIG. 4.

Referring now to FIGS. 4–6, there is shown outer conductor 12 filled with a lower dielectric sheet 50, a center dielectric sheet 52, and an upper dielectric sheet 54. In this particular configuration, primary transmission line 20 and auxiliary transmission line 22 are laminated to opposite surfaces of central dielectric sheet 52 using the conventional photo-etched process previously mentioned. It can be seen that transmission lines 20 and 22 are in considerably closer proximity to one another than in the FIG. 1 embodiment, and therefore, more energy is coupled from primary transmission line 20 to auxiliary transmission line 22. Again, as before, where the coupling region 24 ends, and the transmission lines diverge from close coupling, non-TEM mode coupling exists causing a lack of directivity. In accordance with this invention, this is corrected by etching a planor conductive element 56 in close proximity to the point of diverging which is located on the same plane as primary transmission line 20. Similarly, another conductive element 58 is provided on the opposite side of the coupling region, again in the same plane as primary transmission line 20. Additional conductive elements, such as 62 in the plane of transmission line 22 and underlying element 58 and a similar conductive element (not shown) also in the plane of transmission line 22 and underlying element 56 may likewise be provided.

Again, as before, to provide conductive elements such as 56, 58, 62 and the one underlying element 56 are obtained without any additional cost at the same time as the transmission lines are photo-etched on opposite surfaces of center dielectric slab 52. Of course, any of the three dielectric slabs may be utilized as the copper-clad dielectric slab from which the transmission lines are photo-etched. In other words, for the purpose of this invention, it makes no difference whether the upper surface of lower dielectric slab 50 and the lower surface of upper dielectric slab 54 are copper-clad and are photo-etched to provide the transmission line since the conductive elements can be photo-etched at the same time, regardless of the arrangement.

In the description set forth hereinbefore, a conductive element has been shown on either end of the coupling region. If desired, one of these conductive elements may be omitted if it is found that the remaining conductive element sufficiently increases the directivity. This is particularly true where the coupling in the coupling region is not uniform along the length of the coupling region.

Figure 7:
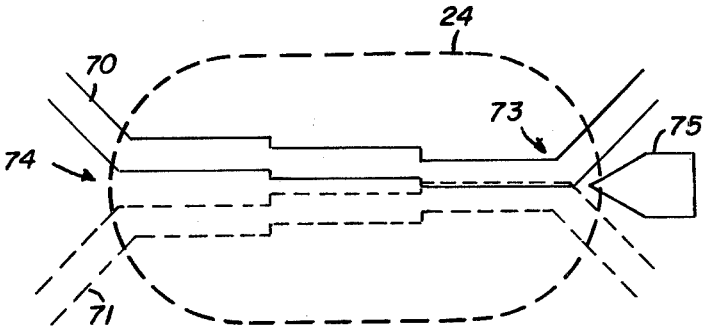
FIG. 7 is a diagrammatic view of a coupled portion of a coupler illustrating a two step transition from tight to loose coupling of the center conductors.

In the embodiment described hereinbefore, the conductors in the coupling region were parallel which makes the coupling substantially uniform along the length of the coupling region. Referring now to FIG. 7, there is shown a pair of transmission lines 70 and 71 which are stepped apart along the coupling region 24 illustrating a transition from close coupling at the end indicated as 73 to loose coupling at the end indicated as 74. Conductive element 75, for greatest effect, is placed to face the tightly coupled end.

In stepped transition configuration, it may be necessary to only provide a single conductive element at the tightly coupled end. Of course, a conductive element may also be placed at the loosely coupled end, but its effect on directivity will be much less pronounced because the loosely coupled end portion does not contribute materially to nondirectivity. Lines 70 and 71 may lie in one plane in which case one element 75 would be utilized, or in two planes, as illustrated, in which case either one element or preferably a pair of overlying elements at the tightly coupled end would be utilized.

Figure 8:
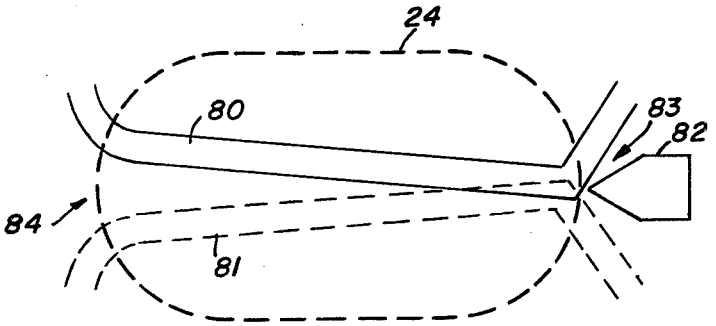
FIG. 8 is a view, similar to the one shown in FIG. 7, illustrating a tapered transition from tight to loose coupling of the center conductors.

Referring now to FIG. 8, there is shown a configuration similar to FIG. 7 but illustrating a tapered transition of the transmission lines 80 and 81 in the coupled region. Strictly speaking, non-TEM mode coupling exists in the coupled region since the coupled lines are not parallel.

However, as long as the taper is gradual, the coupling is still primarily TEM and directivity is not significantly degraded in the tapered coupling region. As before, a conductive element, such as 82, is etched close to and facing the tightly coupled end 83, and loosely coupled end 84 may be left without a conductive element. Lines 80 and 81 may lie in one plane in which case one element 82 would be utilized, or in two planes, as illustrated, in which case either one element or preferably a pair of overlying elements at the tightly coupled end would be utilized.

It should be understood that the conductive elements hereinbefore described are etched at the same time as the center conductors and therefore do not increase the cost. The only additional expense involved in increasing the directivity, in accordance with the invention, is to provide a connection from the conductive element to the outside conductor. But the cost of locating of such a conductor is relatively small when compared with other means of increasing directivity.

There has been described hereinbefore a high directivity TEM mode strip line directional coupler and method of making the same which lends itself to optimization and has great repeatability. The conductive elements which decrease the non-TEM mode coupling at the ends of the coupling section are constructed simultaneously with, using the same processes and material, as the transmission line center conductors. The elements can be accurately placed, utilizing a photo mask, so that the directional couplers will have the same performance from unit to unit without necessity of cumbersome and expensive tuning and expensive testing procedure.

What is claimed is:

1. A TEM mode strip line coupler for coupling energy over a broad frequency range from a primary transmission path to a secondary transmission path with high directivity comprising:

an outer conductor;

a solid dielectric means disposed within and substantially filling said outer conductor;

a planar primary transmission line, for forming the primary transmission path, disposed in a first plane within and supported by said dielectric means;

a planar auxiliary transmission line, for forming the secondary transmission path, disposed in a second plane parallel to said first plane within and supported by said dielectric means, said auxiliary transmission line having a portion in coupling proximity with said primary transmission line to form a coupled portion;

at least one planar conductive element of the same order of thickness as said transmission line, having a pointed end, disposed in a plane selected from said first plane and said second plane, said conductive element being positioned outside but in general alignment with said coupled portion and with said pointed end immediately adjacent and pointing to the end of said coupled portion where the transmission lines diverge; and conductive means for coupling said conductive element to said outer conductor.

2. A TEM mode strip line coupler in accordance with claim 1 in which said transmission lines and said conductive elements are photo-etched copper elements.

3. A TEM mode strip line coupler in accordance with claim 1 in which said conductive element is of generally elongated configuration.

4. A TEM mode strip line coupler in accordance with claim 3 in which said first and second plane are in a common plane, and in which said dielectric means is formed of a section lying on either side of said common plane, and in which said primary transmission line and said secondary transmission line and said conductive element are all supported on one of said dielectric sections.

5. A TEM mode strip line coupler in accordance with claim 4 in which said coupled portion has one loosely coupled end and one tightly coupled end portion, and in which said conductive element is adjacent said tightly coupled end.

6. A TEM mode strip line coupler in accordance with claim 4 in which the ends of said coupled portion are equally coupled, and in which a conductive element is disposed adjacent each end.

7. A TEM mode strip line coupler in accordance with claim 3 in which said dielectric means is formed of a center section lying between said first and second plane and a side section at the remote side of each of said first and second planes, and in which said primary transmission line and one conductive element are disposed on one side of said center section and said auxiliary transmission line and another conductive element are disposed on the other side of said center section.

8. A TEM mode strip line coupler in accordance with claim 7 in which the conductive elements on opposite sides of said center section overlie one another.

9. A TEM mode strip line coupler in accordance with claim 8 in which said coupled portion has one loosely coupled end and one tightly coupled end and in which said overlying conductive elements are adjacent said tightly coupled end.

10. A TEM mode strip line coupler in accordance with claim 7 in which said ends of said coupled portion are both equally coupled and in which a pair of overlying conductive elements are adjacent each end.

11. The method of increasing the directivity of a dielectric-filled TEM mode strip line coupler for coupling energy over a broad frequency range from a primary transmission path to a secondary transmission path utilizing copper-clad dielectric sheets, comprising the steps of:

forming simultaneously with the center conductors of the transmission paths, during the process of etching away the excess of copper from the copper-clad dielectric sheet to form the center conductors, an elongated conductive element having a pointed end in close proximity to and facing the portion of the center conductors disposed in coupling relationship; and connecting said conductive element to the outer conductor of the coupler.

12. A method in accordance with claim 11 in which an elongated conductive element is formed at each end of the portion of the center conductors disposed in coupling relationship.

13. A method in accordance with claim 11 in which the center conductors lie in the same plane and in which the conductive element faces the end portion of the center conductors disposed in closest coupling relationship.

14. A method in accordance with claim 11 in which the center conductors lie in separate and parallel planes and in which a conductive element is formed in each of said planes and disposed to overlie one another.

* * * * *